US006341432B1

(12) United States Patent
Muller

(10) Patent No.: US 6,341,432 B1
(45) Date of Patent: Jan. 29, 2002

(54) SHOE

(75) Inventor: Karl Muller, Roggwil (CH)

(73) Assignee: Negort AG, Roggwill (CH)

( * ) Notice: Subject to any disclaimer, the term of this patent is extended or adjusted under 35 U.S.C. 154(b) by 0 days.

(21) Appl. No.: 09/462,946

(22) PCT Filed: Jul. 3, 1998

(86) PCT No.: PCT/EP98/04116

§ 371 Date: Jan. 18, 2000

§ 102(e) Date: Jan. 18, 2000

(87) PCT Pub. No.: WO99/03368

PCT Pub. Date: Jan. 28, 1999

(30) Foreign Application Priority Data

Jul. 17, 1997 (DE) ..... 297 12 596 U
Nov. 20, 1997 (DE) ..... 297 20 627 U

(51) Int. Cl.[7] ..... A43B 13/28

(52) U.S. Cl. ..... 36/27; 36/102; 36/28; 36/103

(58) Field of Search ..... 36/27, 28, 31, 36/102, 103, 7.8, 179, 37, 38, 29, 3 B

(56) References Cited

U.S. PATENT DOCUMENTS 1,352,865 A * 9/1920 Augestad ..... 36/27
4,236,326 A * 12/1980 Inohara ..... 36/29
5,203,095 A * 4/1993 Allen ..... 36/27
5,701,686 A * 12/1997 Herr et al. ..... 36/27

FOREIGN PATENT DOCUMENTS

| | | | |
|---|---|---|---|
| DE | 9413496 | * | 8/1994 |
| GB | 2150010 | * | 6/1985 |
| GB | 2200030 | * | 7/1988 |
| GB | 2288720 | * | 1/1995 |
| WO | 87/03789 | * | 7/1987 |

* cited by examiner

*Primary Examiner*—Paul T. Sewell
*Assistant Examiner*—J. Mohandesi
(74) *Attorney, Agent, or Firm*—Antonelli, Terry, Stout & Kraus, LLP

(57) ABSTRACT

A shoe includes a sole (2) that extends from a rear heel area (6) through a metatarsal area (7) to a front ball or toe area (8), the sole being composed of a sole body (10) and a sole covering (11) formed on the underside of the sole body (10) and a recess (13) extending approximately from metatarsal area (7) to heel area (6). The recess is provided between sole body (10) and sole covering (11), with the area of sole covering (11) associated with recess (13) forming a pivoting element (18) designed to pivot around a pivot axis (20) located in the end area of recess (13) facing metatarsal area (7). The end area of recess (13) facing metatarsal area (7) is defined by a tip **(13*a*) of recess (13), and the pivot axis (20) is located in the area between a lengthwise center of shoe (1) and heel area (6), with heel area (6) extending over approximately one-third of the length of shoe (1). At least one material element (25) is located in recess (13), the material element (25)** being made of a flexible, soft material and being made approximately wedge-shaped or approximately in the shape of a circular section.

31 Claims, 6 Drawing Sheets

SHOE

BACKGROUND OF THE INVENTION

The present invention relates to a shoe.

Shoes consist of a sole and an upper which surrounds the foot resting on the sole. The soles of shoes often have damping means by which the load exerted on the foot or on the entire body of the runner is eased when running. Known damping means for example are air cushions or gel-filled cavities.

A sole with a plurality of damping elements is known (EP 0 695 514 A1). This sole has, in the heel area, the metatarsal area, and the ball of the foot, a plurality of holes extending in the transverse direction and intended to serve as damping cushions. These holes are given a variety of shapes and sizes and have a correspondingly hard or soft damping effect. In one embodiment, a recess is made in the sole from the rear end which is open at the sides so that the area of the sole beneath forms a plate that projects freely to the rear. Such a sole has a very soft damping characteristic in the heel area.

A sole is also known for an exercise shoe (DE 94 13 496 U1) by which running on the level is made more difficult for training purposes. This sole is cut away in the area associated with the shoe heel so that the wearer of the shoe can run essentially only in the vicinity of the balls of the feet. As a result, an effect like that obtained running uphill on a 15° slope or when climbing stairs is achieved. A shoe of this kind that promotes running on the balls of the feet is unsuited from the health standpoint since, when running on the balls of the feet, the foot or shoe is placed on the ground with the leg extended and the impact load is transferred directly to the knee and hip joints and the spinal column.

SUMMARY OF THE INVENTION

In view of the above disadvantages and shortcomings of the shoe known from the prior art, the goal of the present invention is to provide a shoe with which the shock loads that occur when running are transmitted only to a very slight degree, if at all, to the knee and hip joints and to the spinal column.

This goal is achieved by a shoe having a sole that extends from a rear heel area through a metatarsal area to a front ball or toe area, said sole being made of a sole body and a sole covering located on the underside of the sole body and a recess that extends approximately from the metatarsal area to the heel area and is provided between the sole body and the sole covering; the area of the sole covering associated with the recess forms a pivoting element that is designed to pivot around a pivot axis that is located in the end area of the recess and facing the metatarsal area.

The shoe according to the present invention has a sole composed of a sole body and a sole covering, with a recess extending approximately from the metatarsal area to the heel area, said recess being provided between the sole body and the sole covering so that the area of the sole covering associated with the recess, when placed on a support, is pivoted away upward around a pivot axis so that the shoe is placed very softly on the support.

When the shoe is placed on the support in the vicinity of the pivot axis, it tilts around the pivot axis with the ball or toe area on the support. As a result, the foot and the lower leg are displaced slightly forward and the knee is automatically bent slightly. A leg bent at the knee accepts the impact load through the bones of the skeleton and the surrounding musculature without the impact load being transmitted to the joints or the spinal column.

The shoe according to the present invention therefore produces a rounding effect, in other words a rolling action as it is placed on the support so that the impact load exerted on the sensitive joints or on the spinal column is considerably reduced.

In the standing phase, the wearer of the shoe is also placed in a therapeutic posture, in other words a posture with the knees forced to bend at an angle so that the spinal column is also relieved of a load when standing.

Hence, the invention is based on the knowledge that in conventional shoes, despite costly and cumbersome damping elements, the impact load is transmitted directly to the joints and the spinal column since, with these shoes, the foot or the shoe can be placed on the support with the leg extended.

Preferred embodiments of the present invention are described in the dependent claims.

BRIEF DESCRIPTION OF THE DRAWINGS

In the following, additional designs, features, and advantages of the present invention will be discussed in greater detail with reference to four embodiments that are shown schematically with reference to FIGS. 1 to 6 as examples.

DETAILED DESCRIPTION OF THE PREFERRED EMBODIMENTS

Figure 1:
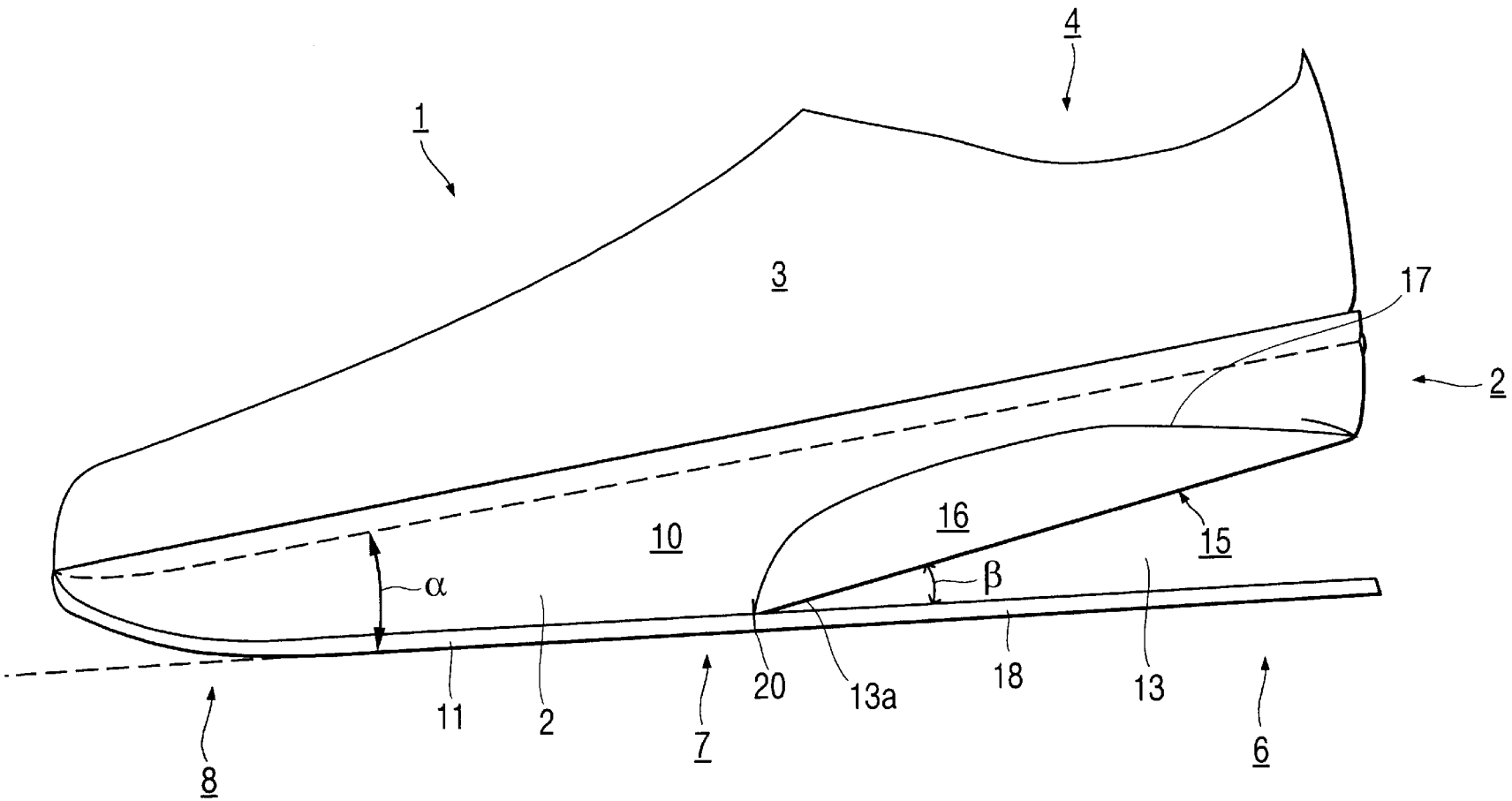
FIG. 1 is a side view of a first embodiment of a shoe according to the present invention.

Identical reference numbers in FIGS. 1 to 6 refer to the same or similar parts of the shoe according to the present invention.

Shoe 1 according to the present invention has a sole 2 and an upper 3 located thereon, said material surrounding a foot (not shown in FIGS. 1 to 6) of a runner. Upper 3 can be closed by shoelaces, hook and loop fasteners, or the like and has an opening 4 through which the foot extends upward in the area of the ankle.

Sole 2 extends from a rear heel area 6 through a metatarsal area 7 to a front ball or toe area 8, with each of these areas 6, 7, 8 extending over approximately one-third of the length of shoe 1.

Sole 2 is made of a voluminous sole body 10 and a sole covering 11 located at its underside. Sole body 10 consists of a material with good damping properties such as a polyester-urethane (PU) foam for example, and sole covering 11 consists of an abrasion-resistant material that is preferably profiled on its underside, hard rubber for example.

The entire sole 2 has a thickness that increases from ball and toe area 8 to heel area 6 so that sole 2 forms a wedge in a side view. The sole top forms an angle $\alpha$ with the underside of the sole and this angle is in the range of approximately 8° to approximately 20°.

Between sole body 10 and sole covering 11 is a recess 13 that expands in a wedge shape from metatarsal area 7 to heel area 8. Sole body 10 forms a stop surface 15 adjacent to recess 13.

Sole covering 11 projects freely rearward adjacent a point 13*a* of recess 13 that points toward ball and toe area 8, with this area of sole covering 11 projecting freely rearward to form a pivoting element 18 which can be pivoted upward against stop surface 15 of sole body 10 around the pivoting area, adjacent recess point 13*a,* between pivoting element 18 and the rest of sole covering 11. A pivot axis 20 extends pivotably relative to pivoting element 18 through sole covering 11 in the transverse direction adjacent to recess tip 13*a*.

A pivot angle β between stop surface 15 and pivoting element 18 is in the range of approximately 10° to approximately 30°, especially in the range from approximately 15° to approximately 20°. The tip 13*a* of recess 13 and hence pivot axis 20 are located in the area between the lengthwise center of shoe 1 and heel area 6 which extends over approximately one-third of the length of shoe 1.

Sole covering 11, especially in the area of pivot axis 20 and pivoting element 18, has considerable dimensional stability and/or flexural strength and is fiber-reinforced, so that sole covering 11 has considerable intrinsic stiffness.

Figure 2:
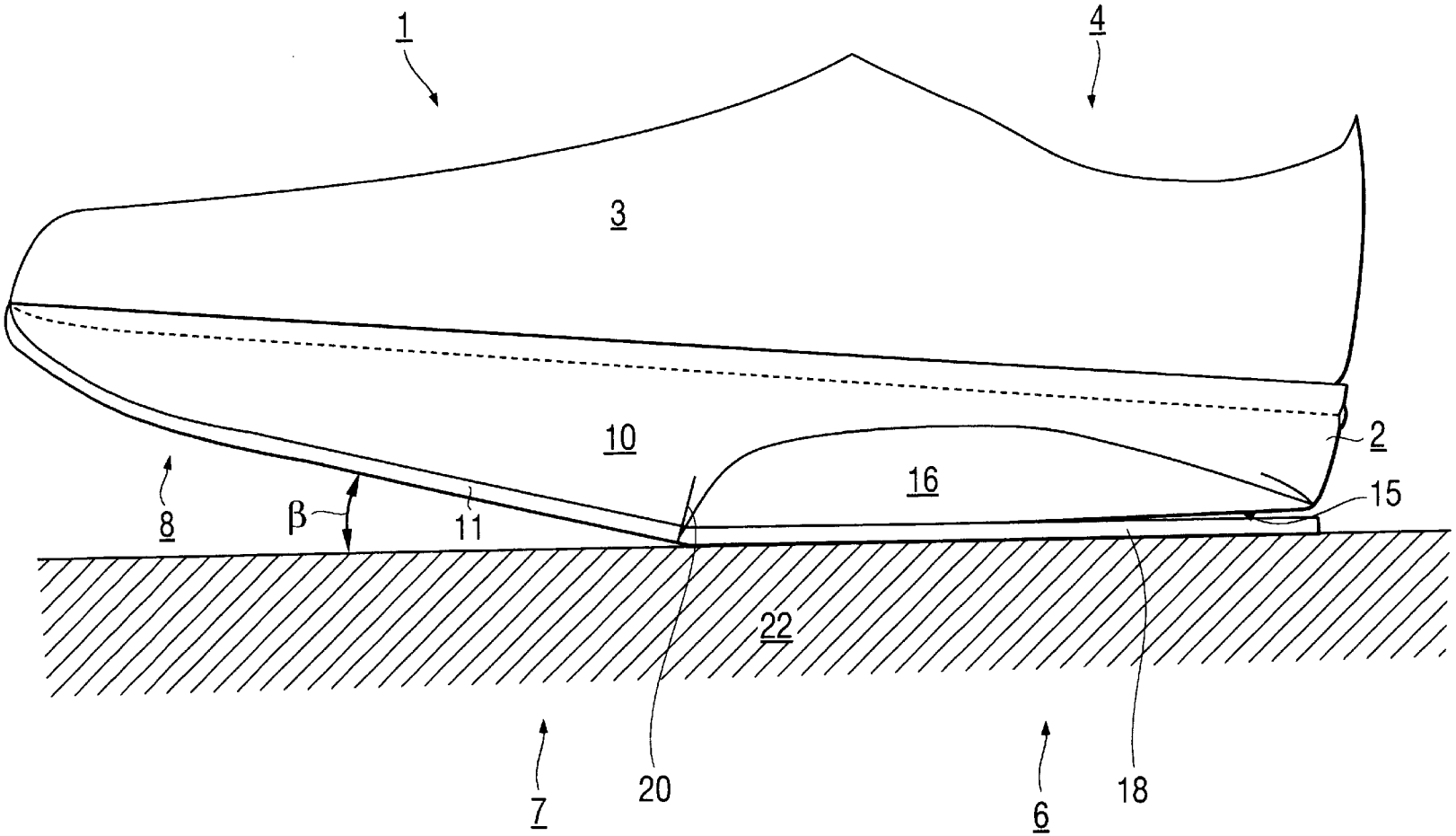
FIG. 2 is a side view of the shoe in FIG. 1 while being subjected to a load on the heel area while setting down or rolling away the foot.

As shown in FIG. 2, shoe 1, because of the wedge shape of the entire sole 2, when placed on a support when running, contacts a support by its sole covering 11 in heel area 6 and thus support 22 by its pivoting element 18. Pivoting element 18 of sole covering 11 is pressed around pivot axis 20 against stop surface 15.

This pivoting movement of pivoting element 18, despite the considerable dimensional stability of sole covering 11, results in a very gentle, yielding placement of shoe 1 on support 22. The restoring force of sole covering 11 is chosen so that no more than 30% and if possible only 10% of the weight of the runner (65 to 75 kg for example) for which shoe 1 is designed is sufficient to press pivoting element 18 against stop surface 15.

When pivoting element 18 strikes stop surface 15 (see FIG. 2), the area of sole 2 or of sole covering 11 that extends from pivot axis 20 to ball or toe area 8 is inclined upward and forward relative to support 22 around pivot angle β. Sole covering 11, when pivoting element 18 is bent away, has an obtuse angle of nearly 180° in the vicinity of pivot axis 20.

When pivoting element 18 strikes stop surface 15, the gentle placement process in heel area 6 is terminated and the load exerted on sole 2 by the foot of the runner is distributed approximately uniformly over the entire length of sole 2. As a result, and because of the momentum of the runner directed in the running direction, shoe 1 tips forward around pivot axis 20 and rests its forward area of sole covering 11 on support 22.

This tilting of shoe 1 causes the foot and lower leg of the runner to be displaced slightly forward in the running direction and the knee is bent slightly between the lower leg and upper leg. The maximum load on the foot or on sole 2 appears only after shoe 1 has tilted or after the runner's knee has bent so that the recoil produced by the impact on support 22 encounters a leg that is already bent at the knee and which can accept the impact load in a gentle manner with elastic flexibility by means of the knee joint with its skeleton and muscles, Shoe 1 according to the present invention thus causes automatic rolling of the foot when running so that by comparison with conventional shoes, a considerably more protective transmission of the impact load to the body is produced.

Figure 3:
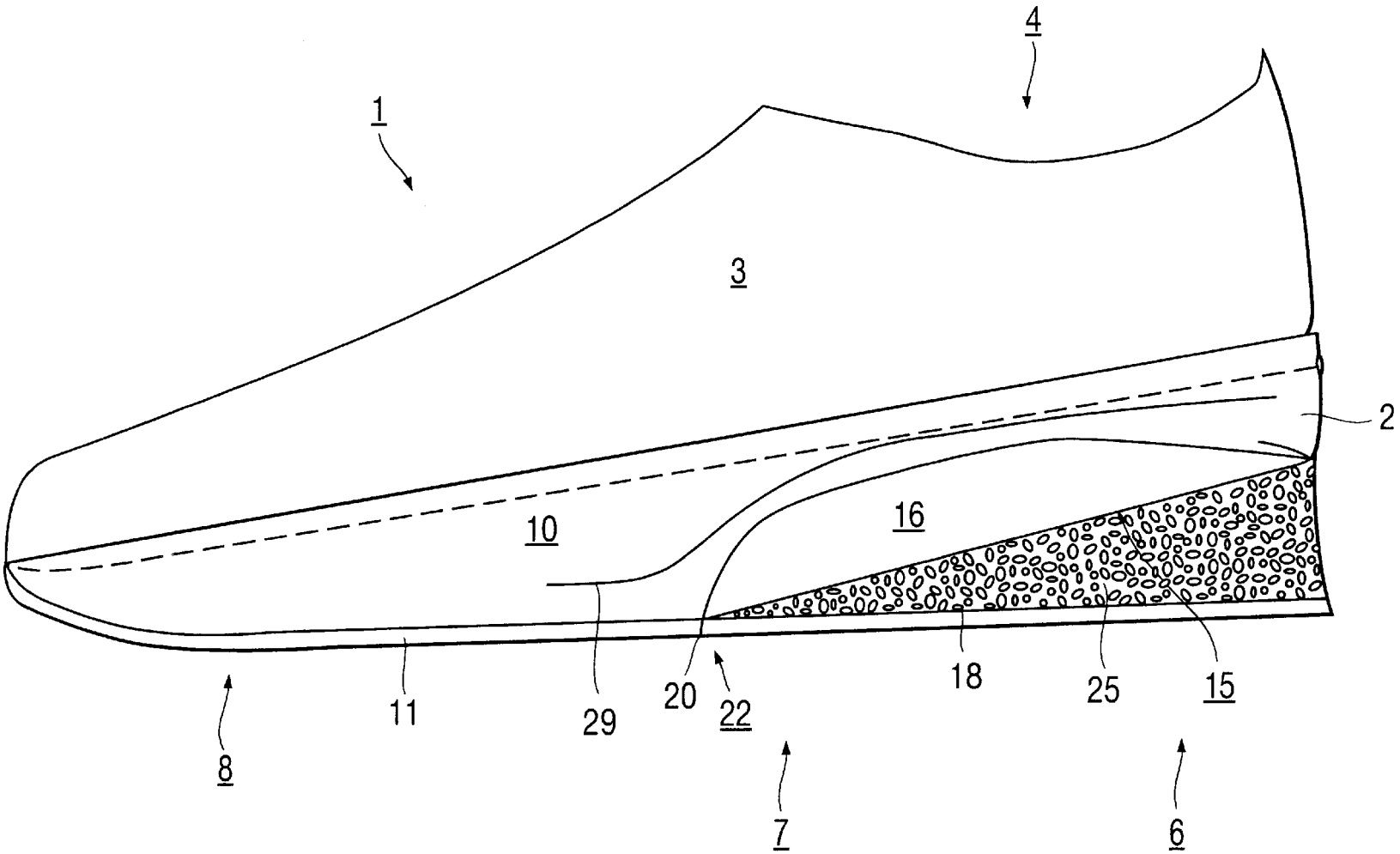
FIG. 3 is a side view of a second embodiment of a shoe according to the present invention.

A second embodiment of the shoe according to the present invention is shown in FIG. 3. This shoe 1 essentially corresponds to the shoe 1 described above; accordingly, the same or similar components have been given identical reference numbers.

Shoe 1 according to FIG. 3, in wedge-shaped recess 13, has a material element in the form of a material wedge 25 made of an open-pored foam. This material wedge 25 is mounted on stop surface 15 of sole body 10 and on pivoting element 18 by means of a glued connection.

Sole covering 11 is divided by a slit 27 in the area of pivot axis 20. The framework of the invention, of course, includes an embodiment without a slit (see for example the fourth embodiment of the present invention shown in FIGS. 5 and 6).

Advantageously, sole covering 11 is flexible in the vicinity of pivot axis 20 and formed by a taper since, in this embodiment of shoe 1, it is advantageous that during the setting down phase of shoe 1 on support 22 in heel area 6, the restoring force of pivoting element 18 is applied if possible only by material wedge 25 in order to ensure that shoe 1 is set down on support 22 as softly as possible.

A reinforcing plate 29 is placed In sole body 10 that extends from the lengthwise center of shoe 1 to rear heel area 6. The reinforcing plate 29 consists of a metal plate or a fiber-reinforced plastic plate and is located at a distance above a pressure distribution part 16, with reinforcing plate 29 being adapted to the curvature of pressure distributing part 16. The reinforcing plate 29 extends in the transverse direction over nearly three-fifths to four-fifths of the width of shoe 1 and during the set-down phase during which pivoting element 18 is pressed against stop surface 1 5, that sole body 10 cannot be tilted downward by the heel.

Figure 4:
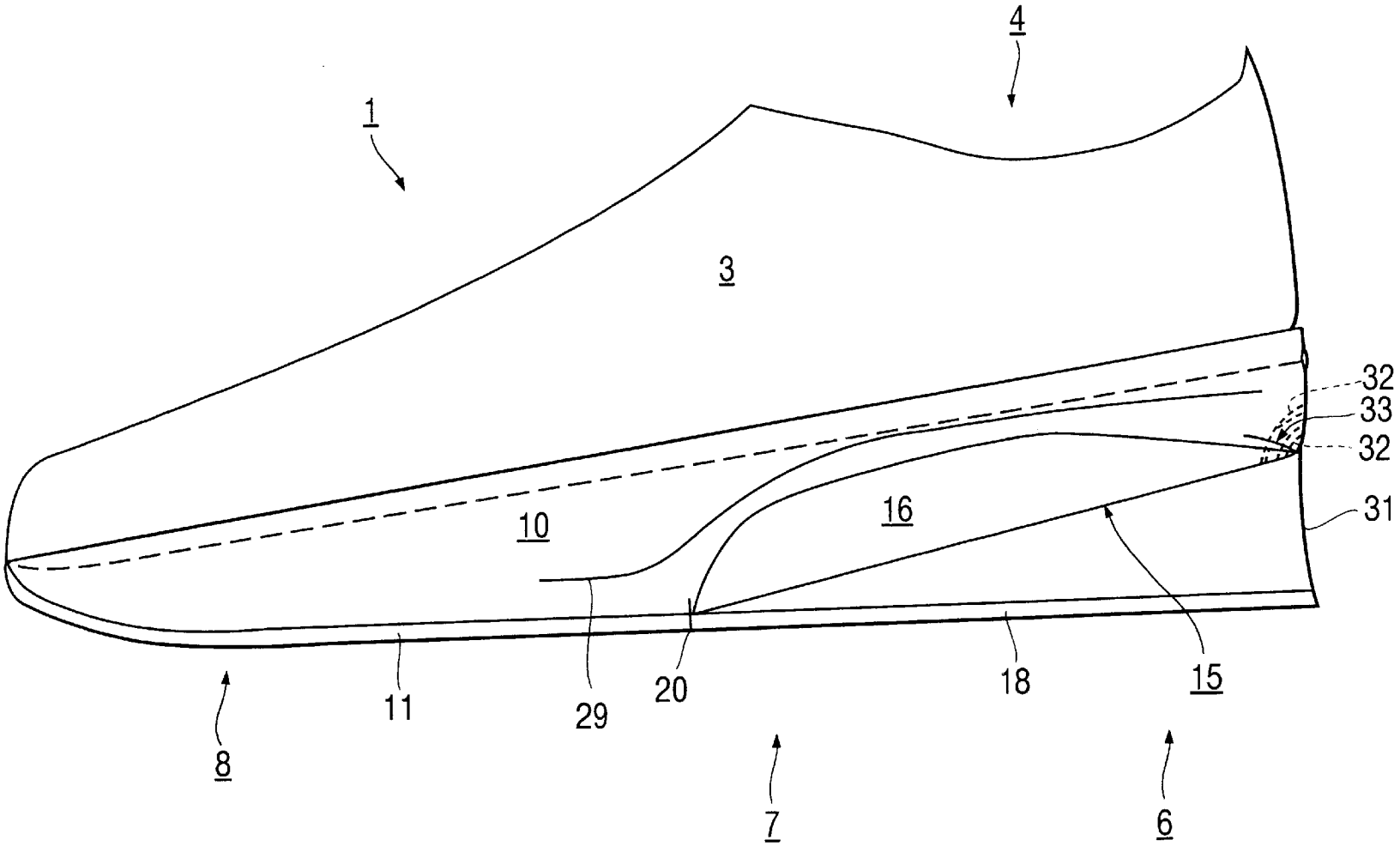
FIG. 4 is a side view of a third embodiment of a shoe according to the present invention.

A third embodiment of the invention is shown in FIG. 4. This shoe 1 has essentially the same structure as shoe 1 described above; accordingly, the same or similar components have identical reference numerals.

The wedge-shaped recess between stop surface 15 and pivoting element 18 is enclosed by an air bellows 31. Two holes 32 are made in sole body 10, said holes terminating at one end at stop surface 15 and at the other end externally on sole body 10.

A valve 33 is placed In each of the two holes 32 which limits the escape of air from air bellows 31 to the outside so that when pivoting element 18 is pressed toward stop surface 15 by the limited escape of air during the pivoting movement of pivoting element 18, a predetermined relatively gentle resistance is offered in opposition.

When the pressure by which pivoting element 18 is pressed against stop surface 15 is released, pivoting element 18 again pivots into the initial position which runs as a straight line extension of the rest of sole covering 11, whereupon valves 33 open and permit a rapid flow of air into air bellows 31.

Pivoting element 18 of sole covering 11 is made in one piece with the rest of sole covering 11 and has a certain degree of dimensional stability or flexural strength so that it automatically pivots back into the initial position following compression of air bellows 31.

Figure 5:
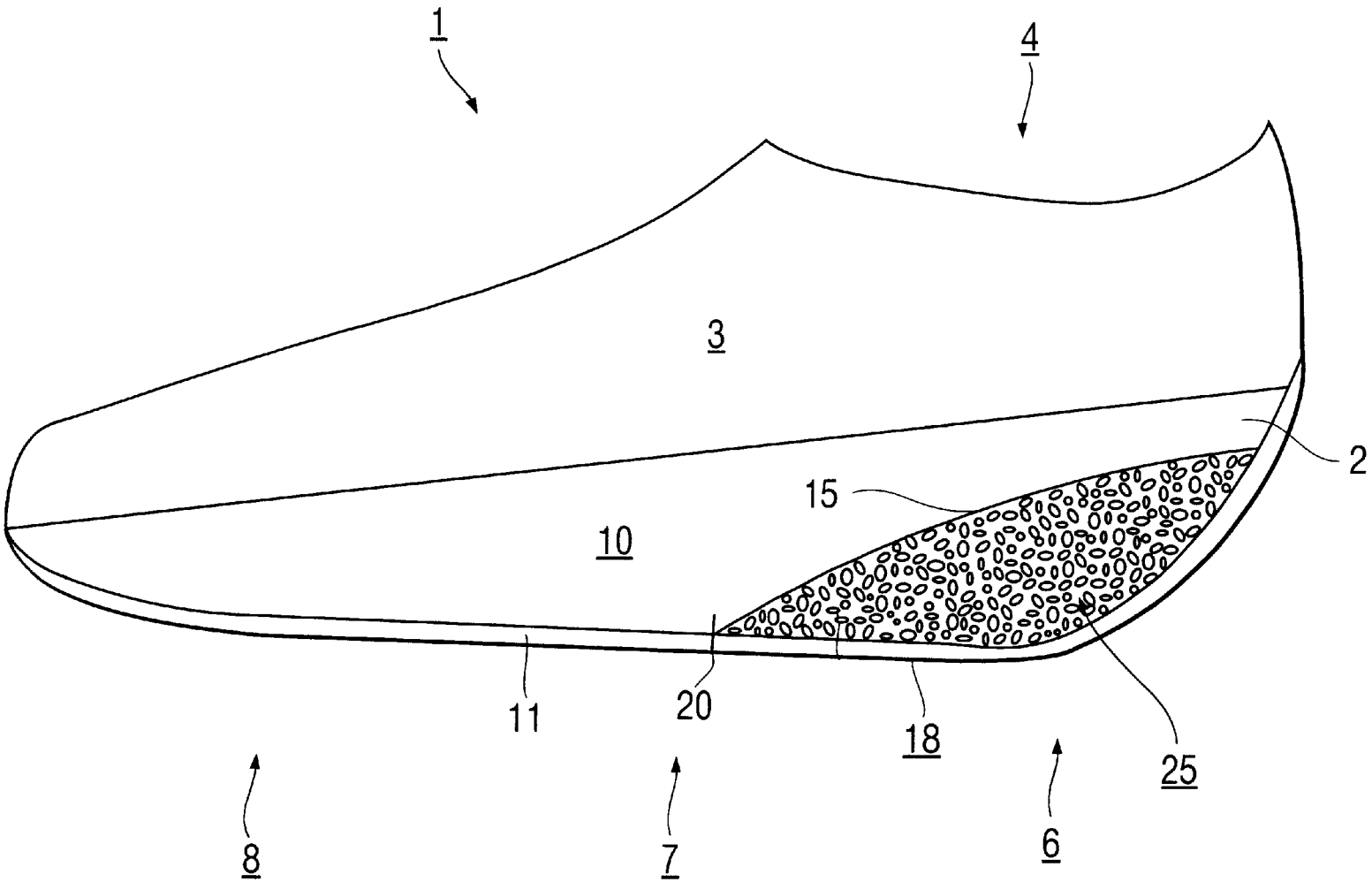
FIG. 5 is a side view of a fourth embodiment of a shoe according to the present invention.
Figure 6:
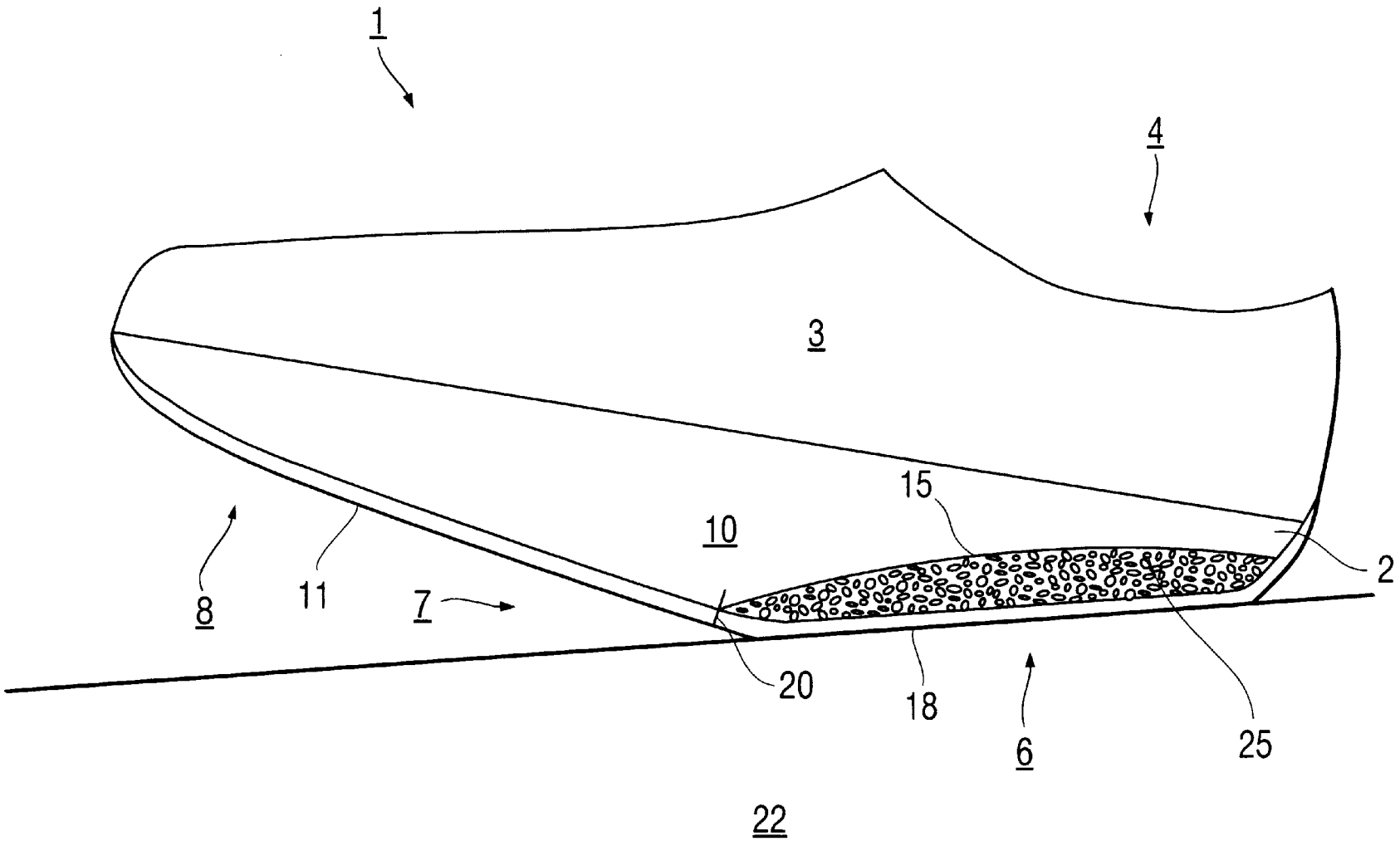
FIG. 6 is a side view of the shoe in FIG. 5 with the heel area being subjected to a load as the foot is set down or rolled away.

The fourth embodiment according to FIG. 5 essentially corresponds to the second embodiment according to FIG. 3, with the only difference being that recess 13 is not wedge-shaped but essentially in the form of a circular section and is filled with a material element 25 made of open-pored plastic.

According to a feature essential to the invention, sole 2 is raised laterally or provided with a very thin lateral covering in the form of side walls made of rubber which cover the plastic core externally for protection and can readily be compressed like a bellows.

In the present invention, therefore, the action of recess 13 is so designed that when rolling on pivot axis 20, recess 13 or its filling does not exert an elastically flexible effect through material element 25 but yields with practically zero force up to the stop when sole covering 11 comes to rest against a hard unyielding area of shoe 1.

Shoe 1 according to the four embodiments described above, is characterized by the fact that when running, a rolling of shoe 1 or the foot on the support is automatically produced. This is effected by wedge-shaped recess 13 between sole body 10 and sole covering 11, since sole covering 11 deflects upward with its pivoting element 18 when subjected to a load in heel area 6 and forms in a gently yielding fashion an obtuse angle at sole 2 whose point is located in the vicinity of pivot axis 20.

Shoe 1 tilts around this obtuse angle in a forward direction so that the knee of the runner is bent and the impact load is received by the runner with a bent knee. The impact load is not transmitted to the sensitive joints and spinal column but is received by the skeleton and the corresponding musculature.

The invention is not limited to the above four embodiments described earlier; the individual skilled in the art can readily devise additional modifications of the invention. For example, the scope of the invention also covers an embodiment in which sole body 10 and sole covering 11 are made in one piece and/or of one part.

What is claimed is:

1. Shoe, comprising a sole (2) that extends from a rear heel area (6) through a metatarsal area (7) to a front ball or toe area (8), said sole being composed of a sole body (10) and a sole covering (11) formed on the underside of the sole body (10) and a recess (13) extending approximately from metatarsal area (7) to heel area (6), said recess being provided between sole body (10) and sole covering (11), with the area of sole covering (11) associated with recess (13) forming a pivoting element (18) designed to pivot around a pivot axis (20) located in the end area of recess (13) facing metatarsal area (7), the end area of recess (13) facing metatarsal area (7) being defined by a tip **(13*a*) of recess (13), pivot axis (20) being located in the area between a lengthwise center of shoe (1) and heel area (6), with heel area (6) extending over approximately one-third of the length of shoe (1), at least one material element (25) being located in recess (13), material element (25)** being made of a flexible, soft material and being made approximately wedge-shaped or approximately in the shape of a circular section.

2. Shoe according to claim 1 characterized in that the area of sole body (10) that faces recess (13) forms a stop surface (15) for delimiting the pivoting movement of pivoting element (18).

3. Shoe according to claim 2 characterized in that at least one hole (32) is provided in sole body (10), said hole extending from stop surface (15) to the exterior of sole body (10).

4. Shoe according to claim 3 characterized in that at least one valve (33) that limits the air opening from recess (13) is located in at least one of holes (32).

5. Shoe according to claim 1 characterized in that pivot axis (20) is located in the plane of sole covering (11).

6. Shoe according to claim 1 characterized in that pivot axis (20) is oriented approximately perpendicularly to the running direction.

7. Shoe according to claim 1 characterized in that sole covering (11) has at least one slit in the vicinity of pivot axis (20).

8. Shoe according to claim 1 characterized in that recess (13) delimits a pivot angle (β) which is in the range from approximately 10° to approximately 30°.

9. Shoe according to claim 8 characterized in that pivot angle (β) lies in the range from approximately 15° to approximately 20°.

10. Shoe according to claim 1 characterized in that recess (13) is made so that it expands in the lengthwise section of shoe (1) toward heel area (6).

11. Shoe according to claim 1 characterized in that recess (13) is made approximately wedge-shaped.

12. Shoe according to claim 1 characterized in that recess (13) is made approximately lens-shaped or approximately in the form of a circular section.

13. Shoe according to claim 1 characterized in that sole covering (11) is designed to be dimensionally stable and/or resistant to bending.

14. Shoe according to claim 1 characterized in that sole covering (11) is fiber-reinforced.

15. Shoe according to claim 1 characterized in that sole covering (11) is made in one piece.

16. Shoe according to claim 1 characterized in that the material element (25) is an open-pored foam.

17. Shoe according to claim 1 characterized in that material element (25) is covered externally.

18. Shoe according to claim 17 characterized in that material element (24) is covered by at least one part of sole covering (11).

19. Shoe according to claim 18 characterized in that sole covering (11) is pulled upward laterally in the direction of sole body (10).

20. Shoe according to claim 1 characterized in that recess (13) is delimited by an air bellows (31).

21. Shoe according to claim 1 characterized in that a reinforcing plate (29) is provided in sole body (10).

22. Shoe according to claim 21 characterized in that the reinforcing plate (29) extends approximately from the lengthwise center of shoe (1) to heel area (6).

23. Shoe according to claim 21 characterized in that reinforcing plate (29) extends in the transverse direction of shoe (1) over approximately three-fifths to approximately four-fifths of the width of shoe (1).

24. Shoe according to claim 21 characterized in that reinforcing plate (29) is made of metal or plastic.

25. Shoe according to claim 24 characterized in that the plastic is fiber-reinforced.

26. Shoe according to claim 1 characterized in that a pressure-distributing element (16) is located between sole body (10) and recess (13).

27. Shoe according to claim 21 and according to claim 26 characterized in that the convexity of reinforcing plate (29) is adapted to the convexity of pressure distribution element (16).

28. Shoe according to claim 1 characterized in that sole (2), in the ball or toe area (8) between its top and bottom, encloses an angle (α) in the range from approximately 8° to approximately 20°.

29. Shoe according to claim 1, characterized in that material element (25) is approximately in the shape of a circular section.

30. Shoe comprising a sole (2) that extends from a rear heel area (6) through a metatarsal area (7) to a front ball or toe area (8), said sole being composed of a sole body (10) and a sole covering (11) formed on the underside of the sole body (10) and a recess (13) extending approximately from metatarsal area (7) to heel area (6), said recess being provided between sole body (10) and sole covering (11), with the area of sole covering (11) associated with recess (13) forming a pivoting element (18) designed to pivot around a pivot axis (20) located in the end area of recess (13) facing metatarsal area (7), the end area of recess (13) facing metatarsal area (7) being defined by a tip (13*a*) of recess (13), pivot axis (20) being located in the area between a lengthwise center of shoe (1) and heel area (6), with heel area (6) extending over approximately one-third of the length of shoe (1), at least one material element (25) being located in recess (13), material element (25) being made of a flexible, soft material and being made approximately wedge-shaped or approximately in the shape of a circular section characterized in that sole covering (11) is made flexible in the vicinity of pivot axis (20).

31. Shoe comprising a sole (2) that extends from a rear heel area (6) through a metatarsal area (7) to a front ball or toe area (8), said sole being composed of a sole body (10) and a sole covering (11) formed on the underside of the sole body (10) and a recess (13) extending approximately from metatarsal area (7) to heel area (6), said recess being provided between sole body (10) and sole covering (11), with the area of sole covering (11) associated with recess (13) forming a pivoting element (18) designed to pivot around a pivot axis (20) located in the end area of recess (13) facing metatarsal area (7), the end area of recess (13) facing metatarsal area (7) being defined by a tip (13*a*) of recess (13), pivot axis (20) being located in the area between a lengthwise center of shoe (1) and heel area (6), with heel area (6) extending over approximately one-third of the length of shoe (1), at least one material element (25) being located in recess (13), material element (25) being made of a flexible, soft material and being made approximately wedge-shaped or approximately in the shape of a circular section characterized in that sole covering (11) has a taper in the vicinity of pivot axis (20).

* * * * *